US008355507B1

(12) United States Patent
Beffa et al.

(10) Patent No.: US 8,355,507 B1
(45) Date of Patent: Jan. 15, 2013

(54) OPTICAL SWITCHING AND DELAY SYSTEMS AND METHODS FOR OPTICAL ENCRYPTION AND/OR OPTICAL DECRYPTION

(75) Inventors: James C. Beffa, Boulder Creek, CA (US); Anthony C. Kowalczyk, San Carlos, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 995 days.

(21) Appl. No.: 12/393,978

(22) Filed: Feb. 26, 2009

Related U.S. Application Data

(60) Provisional application No. 61/033,354, filed on Mar. 3, 2008.

(51) Int. Cl.
*H04K 1/00* (2006.01)

(52) U.S. Cl. ..... 380/256; 380/255; 398/51; 398/76; 398/84; 398/166

(58) Field of Classification Search ..... 380/255–256; 398/51, 76, 84, 166; 708/801
See application file for complete search history.

(56) References Cited

U.S. PATENT DOCUMENTS 6,810,407 B1 * 10/2004 Jaques et al. ..... 708/801
2002/0131114 A1 * 9/2002 Yoo ..... 359/124

* cited by examiner

*Primary Examiner* — Thanhnga B Truong
(74) *Attorney, Agent, or Firm* — McDermott Will & Emery LLP

(57) ABSTRACT

An optical switching and delay system for optical encryption and/or optical decryption may comprise a switch bank, a set of optical delay lines, a combiner, and a processor. The switch bank may be configured to receive an optical signal in a first arrangement and route the optical signal to the set of optical delay lines according to a switching arrangement key. The set of optical delay lines may be configured to provide delays to the optical signal. The combiner may be configured to receive the optical signal with delays from the set of optical delay lines and combine the optical signal into a second arrangement. The processor may be configured to receive the switching arrangement key and control the switch bank according to the switching arrangement key. The switching arrangement key may comprise a set of instructions for routing the optical signal.

13 Claims, 4 Drawing Sheets

OPTICAL SWITCHING AND DELAY SYSTEMS AND METHODS FOR OPTICAL ENCRYPTION AND/OR OPTICAL DECRYPTION

CROSS-REFERENCES TO RELATED APPLICATIONS

The present application claims the benefit of U.S. Provisional Patent Application Ser. No. 61/033,354, entitled "Optical Sampling Encryption and Decryption," filed on Mar. 3, 2008, which is hereby incorporated by reference in its entirety for all purposes.

STATEMENT AS TO RIGHTS TO INVENTIONS MADE UNDER FEDERALLY SPONSORED RESEARCH OR DEVELOPMENT

Not Applicable.

FIELD

The present invention generally relates to optical encryption and decryption, in particular, relates to optical switching and delay systems and methods for optical encryption and/or optical decryption.

BACKGROUND

Because radio frequency (RF) signals are received in the analog domain, wireless communication systems often use Analog-to-Digital Converters (ADC) to convert the received RF signals to digital information. Analog signals, such as RF signals, modulated on an optical carrier are difficult to encrypt without digitizing the information. To encrypt an analog signal, the analog signal is generally first digitized using an ADC and then the information is remodulated on an optical carrier. However, this requires moving the information from the optical domain to the electrical domain, and then back to the optical domain, adding complexity to the overall system and increasing its size, weight, and power (SWaP). Furthermore, decrypting digitally encrypted information having a large number of samples requires a computer with significant processing power.

SUMMARY

According to one aspect of the present invention, a system is provided for the encryption and decryption of an analog optical signal. For the encryption system, the analog optical signal may be provided to a switch bank, which may switch/sort each of the pulses of the analog optical signal, in accordance with a switch matrix controller, onto one of a plurality of different length optical delay lines. The switch matrix controller can be configured by an encryption key decoder to control the switches in the switch bank in accordance with an encryption key provided to the encryption key decoder. Because each of the series of pulses in its original order may be switched onto optical delay lines of different lengths, each of the series of pulses may be received by a combiner at different times and therefore may be combined by the combiner in a different order, producing an encrypted signal. According to another aspect of the present invention, a decryption system for decrypting the encrypted signal is also provided which uses similar components and logic.

In accordance with one aspect of the present invention, an optical switching and delay system for optical encryption and/or optical decryption comprises a first switch bank, a first set of optical delay lines, a first combiner, and a first processor. The first switch bank may be configured to receive an optical signal in a first arrangement. The first switch bank may be configured to route the optical signal to the first set of optical delay lines according to a first switching arrangement key. The first set of optical delay lines may be communicatively coupled to the first switch bank and may be configured to provide delays to the optical signal.

According to another aspect of the present invention, the first combiner may be communicatively coupled to the first set of optical delay lines. The first combiner may also be configured to receive the optical signal with delays from the first set of optical delay lines and combine the optical signal into a second arrangement. The first processor may be communicatively coupled to the first switch bank. The first processor may also be configured to receive the first switching arrangement key and control the first switch bank according to the first switching arrangement key. The first switching arrangement key may comprise a set of instructions for routing the optical signal.

Additional features and advantages of the invention will be set forth in the description below, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate aspects of the invention and together with the description serve to explain the principles of the invention.

DETAILED DESCRIPTION

In the following detailed description, numerous specific details are set forth to provide a full understanding of the present invention. It will be obvious, however, to one ordinarily skilled in the art that the present invention may be practiced without some of these specific details. In other instances, well-known structures and techniques have not been shown in detail so as not to obscure the present invention.

In accordance with one aspect of the present invention, encryption and decryption systems are provided that can advantageously encrypt and decrypt an analog signal without converting the signal to a digital format, thereby significantly reducing the complexity of the architecture and providing a major savings in size, weight, and power (SWaP). The analog signals may be provided by various systems such as a photonic discrete time optical sampling (DTOS) system. A DTOS system samples analog RF signals modulated on an optical carrier onto a pulse stream. This DTOS system is described in U.S. patent application Ser. No. 11/938,157, entitled "RF Discrete Time Optical Frequency Translator", which is hereby incorporated by reference in its entirety.

In accordance with one aspect of the present invention, a stream of optical pulses, for example the optical pulses created by the DTOS system, is utilized and encoded by scrambling the pulses in a pattern as defined by an encryption key, thereby rendering the information meaningless unless the encryption key and the pulse duration are known. One aspect of the present invention allows for encryption with the original optical signal, which provides the benefit of staying optical through the whole process (e.g., the encryption process). According to one aspect of the present invention, an encryption system may assist in preventing unauthorized listening of an analog optical signal by encrypting the analog signal, and may therefore be advantageous in applications used for, without limitation, and by example only, data security, data transmission, data communications, photonics, and optical computing.

Figure 1:
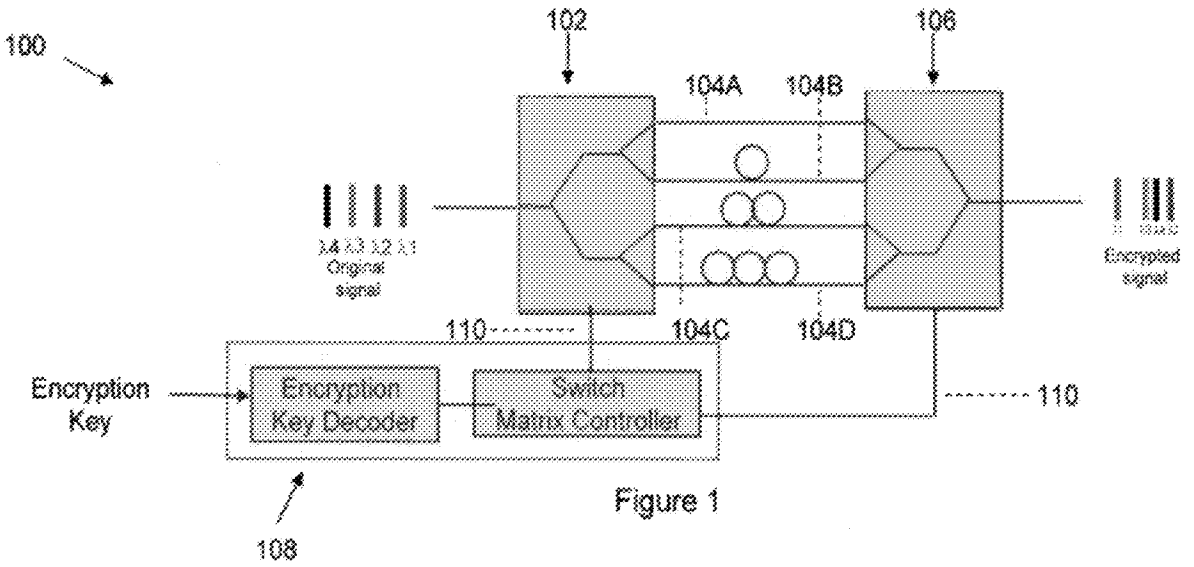
FIG. 1 illustrates a photonic DTOS encryption concept, in accordance with one aspect of the present invention.

FIG. 1 illustrates a photonic DTOS encryption concept, in accordance with one aspect of the present invention.

According to one embodiment of the present disclosure, an encryption system 100 such as a DTOS optical encryption system is provided for the encryption of analog optical signals. For example, an encryption system 100 may take a signal pulse stream and scramble the pulses to prevent unauthorized listening. The analog optical signals, for example, can be DTOS pulses representing standard light signals with different wavelengths as shown in FIG. 1. These analog optical signals are provided to a switch bank 102. For example, the DTOS signals may enter switch bank 102, which may shift, switch, or sort each of the pulses of the analog optical signals, in accordance with a switch matrix controller, onto one of a plurality of different length optical delay lines, such as optical delay lines 104A, 104B, 104C and 104D. In an alternative embodiment, switch bank 102 may also sample the analog optical signals into a series of pulses. In certain aspects, the analog optical signals may be sampled in accordance with the Nyquist-Shannon sampling theorem.

Switch bank 102 may include one optical switch for each two optical delay lines. For example, if there are four optical delay lines, the switch bank includes two optical switches. However, a larger or a small number of switches may be utilized depending on the application. In a preferred embodiment of the present invention, switch bank 102 may comprise a single input, multiple output switch. Switch bank 102 may use, for example, and without limitation, microelectromechanical (MEM) switches, spatial switches, or any other suitable switches.

According to another aspect of the present invention, delay lines may be used to scramble the pulse streams, thereby encrypting the signals. In certain embodiments, the number of optical delay lines depends on the desired level of encryption. For example, in one embodiment, four optical delay lines provide four positions in which to encrypt each pulse of the analog optical signal. In another embodiment having 128 optical delay lines, there are 128 different positions in which to encrypt each pulse of the analog optical signal. In certain embodiments, the optical delay lines are optical fiber delay lines. In other embodiments, other delay lines may be used. The optical delay lines may also vary in length according to different constraints. For example, in certain embodiments, the length of an optical delay line is based on the propagation constant of the analog optical signal.

There may be other ways to adjust the delay of the optical signals. For example, by adjusting the material of the intrinsic waveguide, the propagation time of the optical signals through the optical delay lines may vary depending on the material. For instance, each optical delay line may be comprised of a different material, or at least some of the optical delay lines may be comprised of a different material. However, by using different materials, the loss rate will change.

In a preferred embodiment of the present invention, the delay provided by the optical delay lines can be changed by varying the fiber lengths of the optical delay lines (e.g., the fiber length of each optical delay line is different from one another). In this way, the loss rate may remain the same. The delay provided by each of the optical delay lines may be slower than the pulse rate of the optical signals. For example, if a pulse is provided every nanosecond, then the optical delay lines may be configured to provide a 2 nanosecond, 4 nanosecond, 5 nanosecond, and 6 nanosecond delay. Each delay provided by the optical delay line may vary in a non-repetitive manner with respect to the other optical delay lines to provide better encryption.

Processor 108 may comprise a switch matrix controller and an encryption key decoder. The switch matrix controller can be configured by an encryption key decoder to control the switches in switch bank 102 in accordance with an encryption key provided to the encryption key decoder. For example, after an encryption key is entered into an encryption key decoder, the encryption key decoder may set up switch bank 102 timing and may program the switch matrix controller. In certain embodiments, the switch matrix controller may be implemented using commercially available analog switch controllers. The switch matrix controller may be communicatively coupled to switch bank 102 and combiner 106 via communicative coupling 110 or any other suitable communication medium, wherein communicative coupling 110 can provide signals in either direction.

In accordance with one aspect of the present invention, the switch matrix controller may trigger switches in switch bank 102 to scramble the order of the pulses of the optical signals. The optical delay lines may rearrange the pulses as the switches change to "move" each pulse, in accordance with another aspect of the present invention. The pulses can be recombined in the new order by combiner 106.

Because each of the series of pulses of the analog optical signal in its original order is switched onto optical delay lines of different lengths, each of the series of pulses is received by combiner 106 at different times and therefore combined by combiner 106 in a different order, producing an encrypted signal. In certain embodiments, combiner 106 may incorporate a time-delay when combining the received signals. In an alternative embodiment, combiner 106 may be replaced with another switch bank that mimics the actions of the switch bank used to switch the pulses onto the optical delay lines. For example, if switch bank 102 is configured to switch one pulse to optical delay line 104A, then combiner 106 may be configured to actively search for the pulse from optical delay line 104A. In this way, insertion loss may be minimized.

The encrypted signal produced by encryption system 100 may be virtually indistinguishable from signal noise. The encrypted signal, for example the DTOS pulse train, can be decoded by the same system with the encryption key. Otherwise, the pulse train would look like noise. Furthermore, the encryption and decryption systems disclosed herein can advantageously encrypt and decrypt an analog signal without converting the signal to a digital format, thereby reducing the complexity of the architecture and providing a savings in SWaP.

For illustrative purposes, it may be helpful to follow an example of an operation of the encryption of the analog signals with wavelengths λ1 through λ4 as shown in FIG. 1. Switch bank 102 may be configured to receive the stream of the analog signals in a first arrangement. In this example, the first arrangement of the analog signals involves having the λ1 through λ4 signals arranged in numerical order and evenly spaced apart. Switch bank 102 may be configured to route each analog signal to the optical delay lines according to a switching arrangement key, such as the encryption key. For example, the switching arrangement key can comprise a set of instructions to route the analog signals. Processor 108 may be configured to receive a switching arrangement key and control switch bank 102 and combiner 106 according to the switching arrangement key. The switching arrangement key may be configured to control switch bank 102 to direct each of the analog signals to the optical delay lines and rearrange the analog signals from the first arrangement into a second arrangement. The switching arrangement key may also be configured to prevent combiner 106 from receiving the analog signals at the same time.

Four optical delay lines are shown in this example as optical delay lines 104A, 104B, 104C, and 104D. Each delay line is shown to have a different delay, with more circles on the line representing a longer delay and less circles representing a shorter delay. For example, optical delay line 104A has zero circles, which represents the shortest delay out of the four optical delay lines, while optical delay line 104D has four circles, which represents the longest delay out of the four optical delay lines.

In this example, switch bank 102 may be configured to route the λ1 signal to optical delay line 104D according to the switching arrangement key. Similarly, switch bank 102 may be configured to route the λ2 signal to optical delay line 104A, the λ3 signal to optical delay line 104C, and the λ4 signal to optical delay line 104B. Combiner 106 is configured to receive the analog signals from the optical delay lines and combine them into one stream, thus outputting the analog signals in the second arrangement as an encrypted signal. Because the λ1 signal travels through the longest delay, the λ1 signal is now last in order. Conversely, because the λ2 signal travels through the shortest delay, the λ2 signal is now first in order. Furthermore, the spacing between the signals is also different in the second arrangement than in the first arrangement. In accordance with one aspect of the present invention, an encryption system is provided that is capable of changing the spacing, or the pulsewidth, of the analog signals to provide further encryption.

Figure 2:
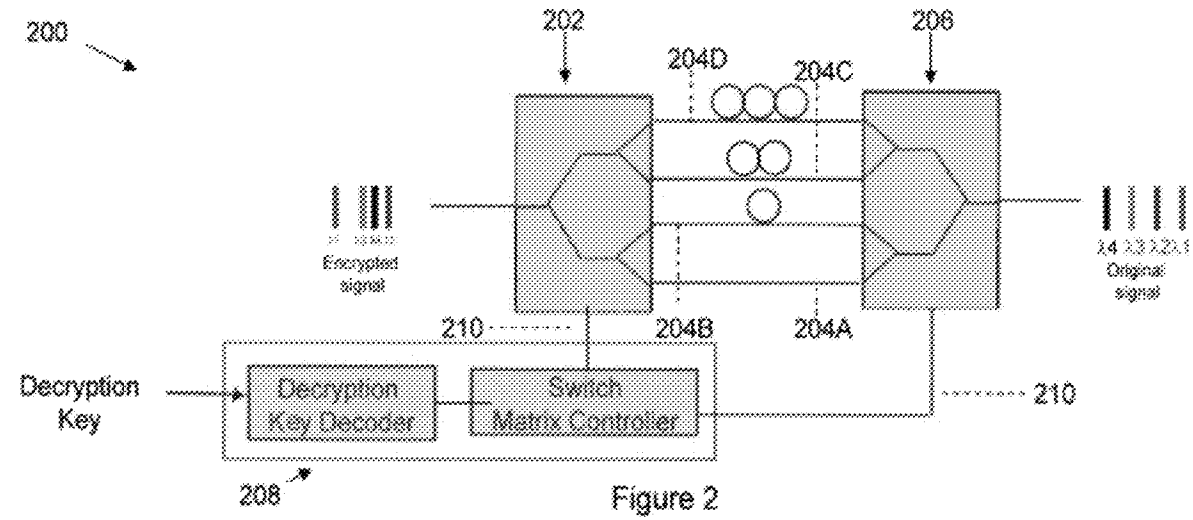
FIG. 2 illustrates a photonic DTOS decryption concept, in accordance with one aspect of the present invention.

FIG. 2 illustrates a photonic DTOS decryption concept, in accordance with one aspect of the present invention.

Decryption system 200 is shown in FIG. 2. In accordance with one aspect of the present invention, decryption system 200 comprises the same components and logic as encryption system 100 and functions in virtually the same way, except in reverse configuration as for some of the components. For example, processor 208 is a duplicate of processor 108, switch bank 202 is a duplicate of switch bank 102, combiner 206 is a duplicate of combiner 106, and the optical delay lines of FIG. 2 are duplicates of the optical delay lines of FIG. 1, except in reverse order. The decryption key matches the encryption key, so that optical signals encrypted with the encryption key can be decrypted with the decryption key.

In accordance with on aspect of the present invention, to decrypt the encrypted signal produced by encryption system 100, the encrypted signal is provided to switch bank 202, which, under the control of the switch matrix controller, switches each of the pulses of the encrypted signal onto one of a plurality of optical delay lines of the same lengths used in encryption system 100, except that the optical delay lines are configured in the reverse order of the optical delay line configuration of encryption system 100 ("reverse-order optical delay lines"). For example, if in the encryption system a first, short optical delay line is connected to a first gate and a last, long optical delay line is connected to a last gate, then, in the decryption system, the first optical delay line is connected to the last gate and the last optical delay line is connected to the first gate. The switch matrix controller of decryption system 200 may be configured by the encryption key decoder to control the switches in switch bank 202 in accordance with the same encryption key provided to the encryption key decoder in encryption system 100. Each of the series of pulses is switched onto the reverse-ordered optical delay lines, and the series of pulses is received and combined by combiner 206 into their original order, thereby reproducing the original analog optical signal. Thus, in order to decrypt the signal, the encryption key and the lengths of the optical fiber lines should be known.

For illustrative purposes, it may be helpful to follow an example of an operation of the decryption of the encrypted analog signals with wavelengths λ1 through λ4 shown in FIG. 1. Switch bank 202 may be configured to receive a stream of encrypted signals, such as the stream of analog signals in the second arrangement from FIG. 1. In this example, the second arrangement of the analog signals involves having the λ1 through λ4 signals arranged out of numerical order, with the first three signals spaced closer together than with the last signal. Switch bank 202 may be configured to route each analog signal to the optical delay lines according to a switching arrangement key, such as the encryption key used in encryption system 100. Processor 208 may be configured to receive the switching arrangement key and control switch bank 202 and combiner 206 according to the switching arrangement key. The switching arrangement key may be configured to control switch bank 202 to direct each of the analog signals to the optical delay lines and rearrange the analog signals from the second arrangement back into the first arrangement of FIG. 1. The switching arrangement key may also be configured to prevent combiner 206 from receiving the analog signals at the same time.

Notice that the optical delay lines 204A, 204B, 204C, and 204D are shown in reverse order in FIG. 2 as compared to the optical delay lines 104A, 104B, 104C, and 104D in FIG. 1. Thus, optical delay line 204D, shown on top, provides the longest delay while optical delay line 204A, shown on bottom, provides the shortest delay. In this example, by using a decryption system that is virtually a duplicate of the encryption system, except that the optical delay lines are in reverse order, the signals travel through the same route except that the optical delay line lengths are different. For example, switch bank 202 may be configured to route the λ2 signal to optical delay line 204D according to the switching arrangement key. Similarly, switch bank 202 may be configured to route the λ4 signal to optical delay line 204C, the λ3 signal to optical delay line 204B, and the λ1 signal to 104A. Combiner 206 is configured to receive the analog signals from the optical delay lines and combine them into one stream, thus outputting the analog signals back into the first arrangement, providing the decrypted original signal.

In accordance with one aspect of the present invention, the analog signals are routed by decryption system 200 to experience an inverse amount of delay as experienced in encryption system 100. In other words, each signal experiences the same total delay being routed through both encryption system 100 and decryption system 200 for encryption and decryption. For illustrative purposes only, the λ1 signal may experience a total delay of three representative circles, with three circles from encryption system 100 and zero circles from decryption system 200. Similarly, the λ2 signal may also experience a total delay of three representative circles, with zero circles from encryption system 100 and three circles from decryption system 200. Thus, the λ1 and λ2 signals are back in their original arrangement relative to each other because each signal experienced the same amount of delay.

Figure 3:
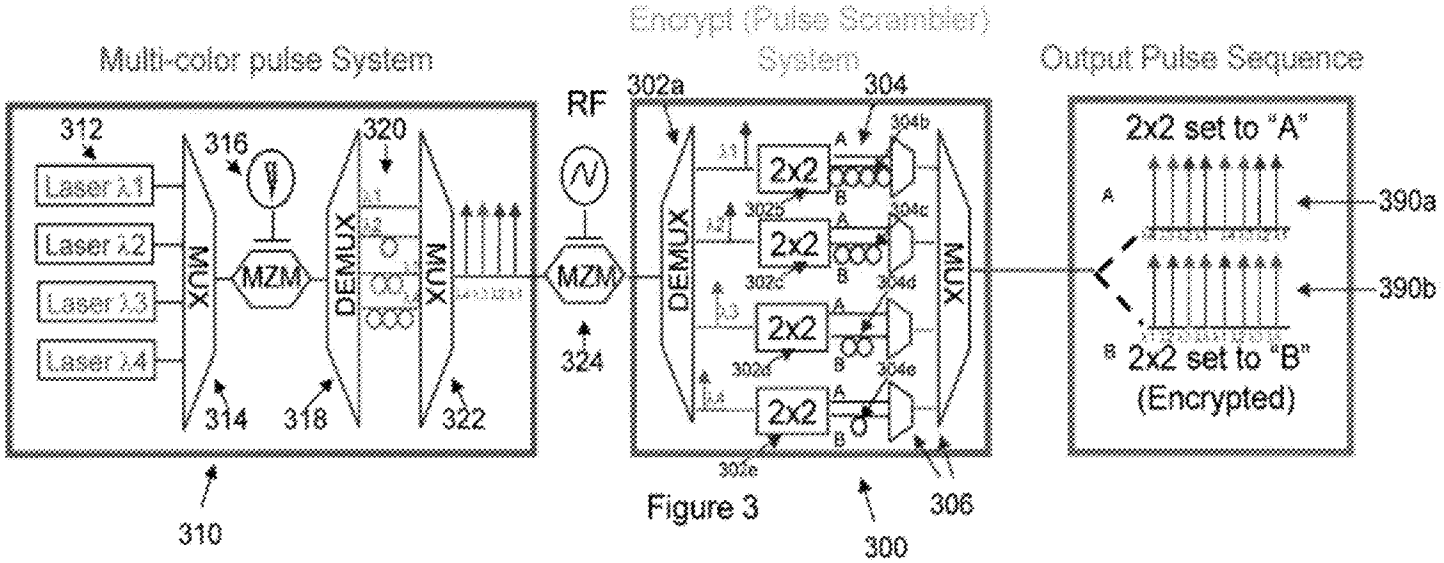
FIG. 3 is an example of an operation of DTOS encryption, in accordance with one aspect of the present invention.

FIG. 3 is an example of an operation of DTOS encryption, in accordance with one aspect of the present invention.

Although FIG. 3 illustrates one way of implementing DTOS encryption, other configurations may be possible. In one aspect of the present invention, the optical pulse train does not need to be monochromatic. The optical pulse train can include multiple optical carrier signals on a single optical fiber by using different wavelengths, or colors, of laser light to carry different signals. Each optical color can have a different optical sample pulse repetition frequency.

A multi-color pulse system illustrates a wavelength division multiplexer system 310. The wavelength division multiplexer system 310 can create an optical pulse train having multiple optical carrier signals on a single fiber using different wavelengths, or colors, of laser light to carry different signals with each optical color having a different optical sample pulse repetition frequency. To create the optical pulse train, the wavelength division multiplexer system can contain a number of continuous wave lasers 312 such as Laser λ1, Laser λ2, Laser λ3, and Laser λ4 with each laser having a different wavelength. The laser pulses are then multiplexed onto a single optical fiber using an arrayed waveguide grating (AWG) multiplexer 314. The optical pulse frequency or repetition rate may be selected to be four times the desired translation frequency at the output of the wavelength division multiplexer system.

In turn, the output colors λ1, λ2, λ3, and λ4 are lead into a high speed Mach-Zehnder Modulator (MZM) interferometer 316 that creates pulses which temporally overlap. A mux 322/demux 318 pair connected with optical lines 320 having different fiber lengths, may then be used to offset the multi-wavelength pulses temporally to achieve a given pulse repetition interval (PRI) that feeds into MZM 324. MZM 324 impresses RF information onto the optical pulse carriers λ1, λ2, λ3, and λ4. The wavelength division multiplexer system 310 can be implemented by various hardware, which may include, for example and without limitation, ILX laser crates (200 GHz channels), Gemfire PM AWGs (mux/demux), EO Space MZMs (20 GB/s 1×1), fiber patch cords (fixed relative length), an Agilent pattern generator, PSPL high speed driver amps, and an Agilent vector signal generator. In another aspect of the present invention, other functionally equivalent methods of creating multi-wavelength optical pulses are available and could also be used.

Encryption system 300 can be implemented with switch bank 302, optical delay lines 304, and combiner 306. Switch bank 302 may comprise a demultiplexer 302*a* and several 2×2 switches 302*b*, 302*c*, 302*d*, and 302*e*. In another embodiment, the 2×2 switches may be replaced with a 1×N switch, or other one or more switches. Combiner 306 may comprise one multiplexer or multiple multiplexers. In one embodiment, the multiplexers can be cascaded. Encryption system 300 can be implemented by various hardware, which may include, for example and without limitation, JDSU 2×2 switches, Gemfire PM AWGs (mux/demux), JDSU wavelength interleavers, and adjustable true time delay units. The switch/latch speed of JDSU 2×2 switches limits RF frequency of experiment via Nyquist.

After MZM 324 has impressed RF information onto the optical pulse carriers λ1, λ2, λ3, and λ4, the resulting optical signals λ1, λ2, λ3, and λ4 are input into encryption system 300 in a first arrangement, with the λ1 signal first, the λ2 signal second, the λ3 signal third, and the λ4 signal fourth. The demultiplexer of switch bank 302 may receive the optical signals and act as a splitter to route each signal to a different 2×2 switch, as shown in FIG. 3. When the 2×2 switches are set to "A", there is no encryption and the optical signals are combined by combiner 306 into its original order, which is the order of the optical signals input into encryption system 300. The combiner 306 may produce an output signal such as the optical pulse sequence 390*a*.

In accordance with one aspect of the present invention, encryption is enabled when the 2×2 switches are set to "B". Thus, the λ1 signal will be routed via the 2×2 switch 302*b* to an optical delay line 304*b* with the longest delay, as represented by the most circles. The other signals, λ2, λ3, and λ4 are routed similarly via the 2×2 switches 302*c*, 302*d*, 302*e*, to the optical delay lines 304*c*, 304*d*, 304*e*, respectively with the λ4 signal being routed to the optical delay line 304*e* having the shortest delay. The optical signals are then combined by combiner 306 in the order that the optical signals arrive. Thus, combiner 306 is configured to combine the optical signals and output them into a second arrangement (see the optical pulse sequence 390*b*). The output pulse sequence 390*b* shows that in this case, the optical signals are encrypted in reverse order, with the λ4 signal first and the λ1 signal last. Digital demodulation signal to noise ratio can be used to verify/assess encryption. This can be performed with various hardware, which may include for example and without limitation, an Agilent oscilloscope (ADC), Agilent digital demodulation software, an LNA (g=15 dB), and a lowpass filter.

Figure 4:
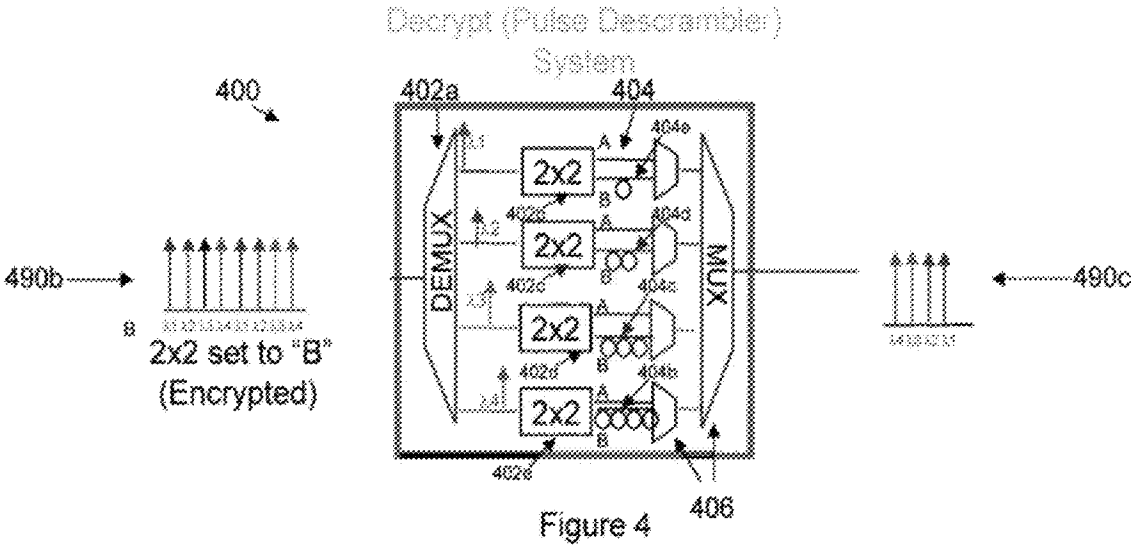
FIG. 4 is an example of an operation of DTOS decryption, in accordance with one aspect of the present invention.

FIG. 4 is an example of an operation of DTOS decryption, in accordance with one aspect of the present invention.

In accordance with one aspect of the present invention, decryption system 400 comprises the same components and logic as encryption system 300 and functions in virtually the same way, except in reverse configuration as for some of the components. Decryption system 400 can be implemented with switch bank 402, optical delay lines 404, and combiner 406. Optical delay lines 404, compared to the optical delay lines of encryption system 300, are configured in reverse order. For example, optical delay lines 404 may be duplicates of the optical delay lines of encryption system 300, except in reverse order as shown in FIG. 4. Switch bank 402 may comprise a demultiplexer 402*a* and several 2×2 switches 402*b*, 402*c*, 402*d*, and 402*e*. In another embodiment, the 2×2 switches may be replaced with a 1×N switch, or other one or more switches. Combiner 406 may comprise one multiplexer or multiple multiplexers. In one embodiment, the multiplexers can be cascaded. Decryption system 400 can be implemented by various hardware, which may include, for example and without limitation, JDSU 2×2 switches, Gemfire PM AWGs (mux/demux), JDSU wavelength interleavers, and adjustable true time delay units. The switch/latch speed of JDSU 2×2 switches limits RF frequency of experiment via Nyquist.

The encrypted optical signals, for example optical pulse sequence 390*b* of FIG. 3, can be input into decryption system 400. The demultiplexer of switch bank 402 may receive the optical signals and act as a splitter to route each signal to a different 2×2 switch, as shown in FIG. 4. When the 2×2 switches are set to "A", there is no decryption and the optical signals are combined by combiner 406 into its previous order, which is the order of the optical signals input into decryption system 400, for example optical pulse sequence 490*b*.

In accordance with one aspect of the present invention, decryption is enabled when the 2×2 switches are set to "B". Thus, the λ1 signal will be routed via the 2×2 switch 402*b* to an optical delay line 404*e* with the shortest delay because the optical delay lines have been reversed. The other signals, λ2, λ3, and λ4 are routed similarly via the 2×2 switches 402*c*, 402*d*, 402*e*, to the optical delay lines 404*d*, 404*c*, 404*b*, respectively with the λ4 signal being routed to the optical delay line 404*b* having the longest delay. The optical signals are then combined by combiner 406 in the order that the optical signals arrive. Thus, combiner 406 is configured to combine the optical signals and output them back into the first arrangement (see the optical pulse sequence 490*c*). The output pulse sequence 490*c* shows that in this case, the optical signals are decrypted back into its original order, with the λ4 signal last and the λ1 signal first.

Figure 5:
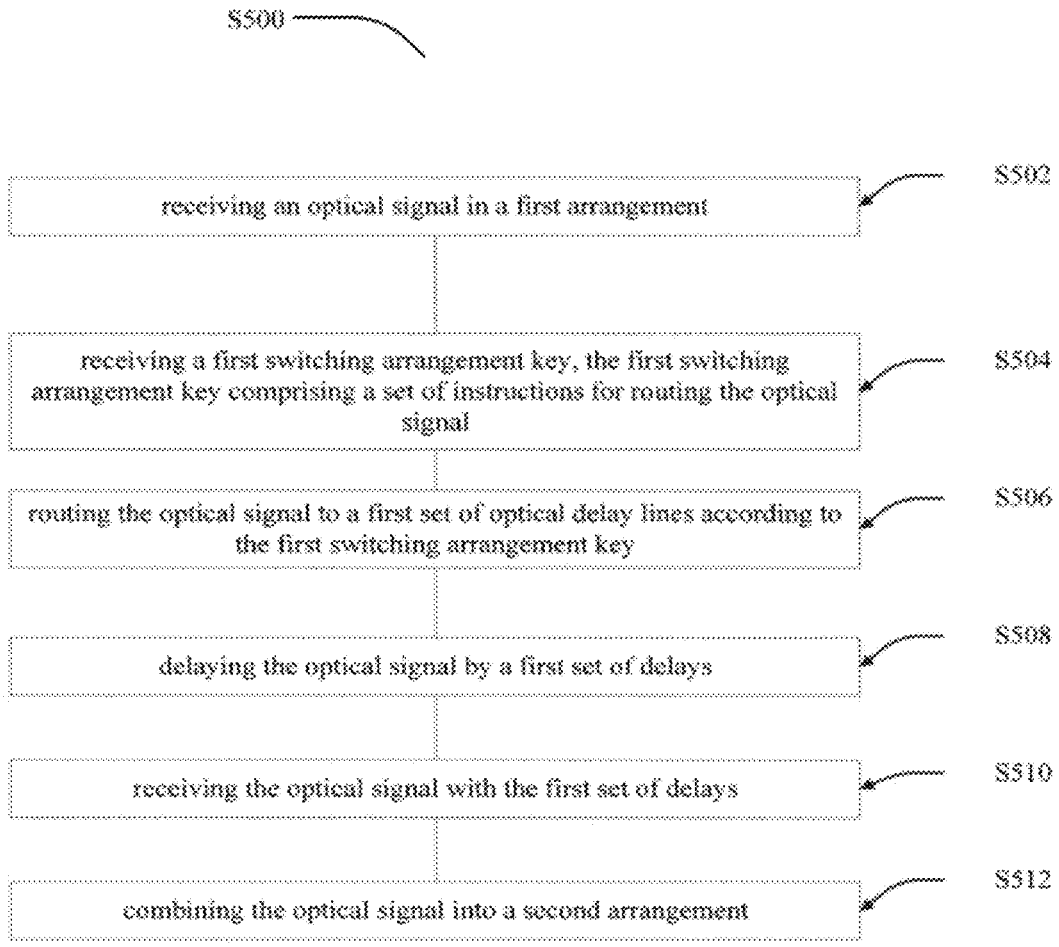
FIG. 5 illustrates a method of encryption, in accordance with one aspect of the present invention.

FIG. 5 illustrates a method of encryption, in accordance with one aspect of the present invention.

An encryption method 5500 is provided in FIG. 5. In accordance with one aspect of the present invention, encryption method 5500 comprises receiving an optical signal in a first arrangement (S502). The optical signals may be, for example and without limitation, the signals provided by a DTOS system. The optical signals in the first arrangement may be the original signal. The method further comprises receiving a first switching arrangement key, the first switching arrangement key comprising a set of instructions for routing the optical signal (S504). The first switching arrangement key may be an encryption key, for example. The method further comprises routing the optical signal to a first set of optical delay lines according to the first switching arrangement key (S506) and delaying the optical signal by a first set of delays (S508). Each signal, depending on the route, may receive a different delay from the other signals, thereby scrambling the original signals. The method further comprises receiving the optical signal with the first set of delays (S510) and combining the optical signal into a second arrangement (S512). The optical signals in the second arrangement may be the decrypted signal of the original signal.

Figure 6:
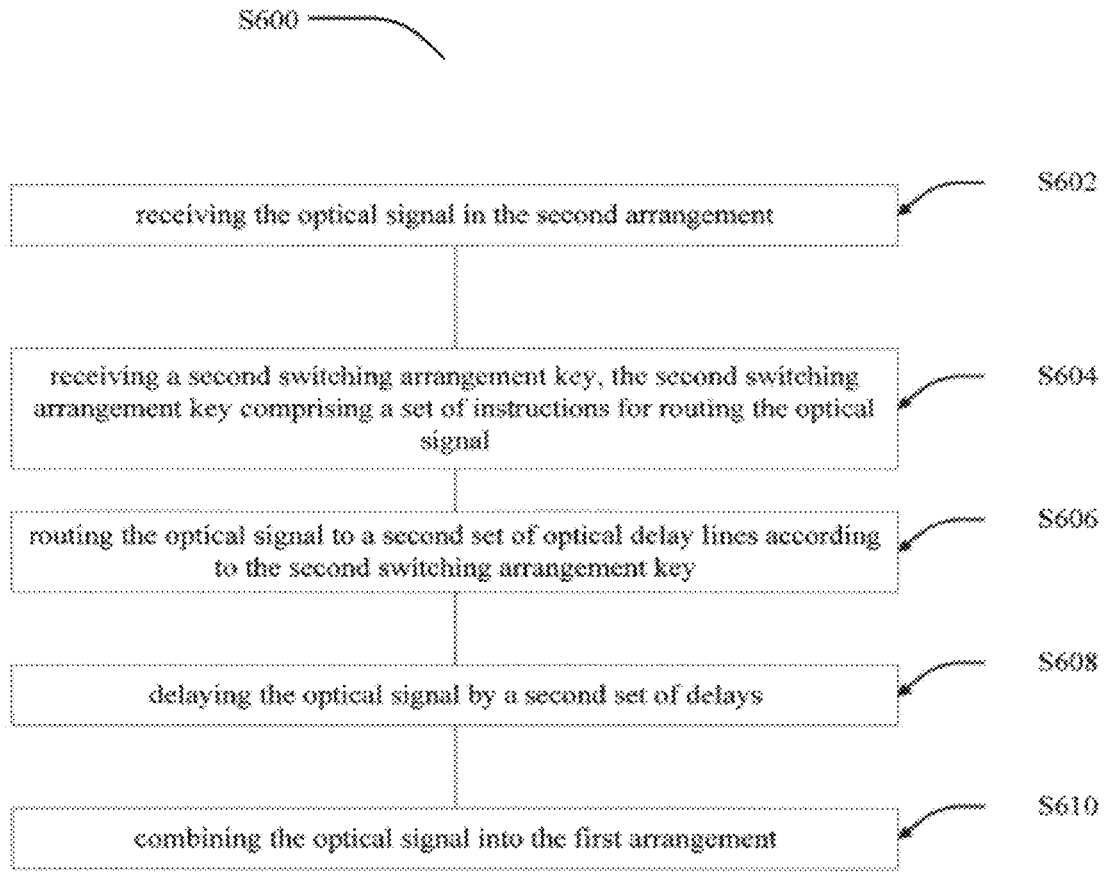
FIG. 6 illustrates a method of decryption, in accordance with one aspect of the present invention.

FIG. 6 illustrates a method of decryption, in accordance with one aspect of the present invention.

A decryption method 5600 is provided in FIG. 6. In accordance with one aspect of the present invention, decryption method 5600 comprises receiving the optical signal in the second arrangement (S602). These optical signals may be, for example, the decrypted signal of FIG. 5. The method further comprises receiving a second switching arrangement key, the second switching arrangement key comprising a set of instructions for routing the optical signal (S604). The method further comprises routing the optical signal to a second set of optical delay lines according to the second switching arrangement key (S606) and delaying the optical signal by a second set of delays (S608). The method further comprises combining the optical signal into the first arrangement (S610). For example, by combining the optical signals back into the first arrangement, the decrypted signal can be converted back to the original signal.

In accordance with one aspect of the present invention, the second switching arrangement key matches the first arrangement key, and the second set of optical delay lines is a duplicate of the first set of optical delay lines in a reverse order. According to another aspect of the present invention, the second set of delays is the inverse of the first set of delays. For example, if a first optical signal is delayed 2 nanoseconds under the first set of delays and a second optical signal is delayed 3 nanoseconds under the first set of delays, then each of the optical signals would have to be delayed under the second set of delays so that each optical signal would experience the same total delay. Thus, if the first optical signal in the example above is delayed 4 nanoseconds under the second set of delays, the second optical signal would have to be delayed 3 nanoseconds under the second set of delays so that each optical signal would experience a total delay of 6 nanoseconds. Because the encrypted signals are delayed by an inverse set of delays, each optical signal is ensured to be delayed by the same amount of delay between encryption and decryption with respect to the other optical signals. As a result, the optical signals experience a first set of delays after encryption and then experience a second set of delays, or an inverse set of delays, to "even" out the delays among the optical signals so that each optical signal experiences the same total delay after encryption and decryption.

The encryption and decryption techniques described herein may be implemented by various means. For example, these techniques may be implemented in hardware, software, or a combination thereof. For a hardware implementation, the processing units used to perform encryption, decryption, switching and combining may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof.

For a software implementation, the encryption and decryption techniques may be implemented with modules (e.g., procedures, functions, and so on) that perform the functions described herein. The software codes may be stored in a memory unit and executed by a processor (e.g., processor 108). The memory unit may be implemented within the processor or external to the processor, in which case it can be communicatively coupled to the processor via various means as is known in the art.

The description of the invention is provided to enable any person skilled in the art to practice the various configurations described herein. While the present invention has been particularly described with reference to the various figures and configurations, it should be understood that these are for illustration purposes only and should not be taken as limiting the scope of the invention.

There may be many other ways to implement the invention. Various functions and elements described herein may be partitioned differently from those shown without departing from the sprit and scope of the invention. Various modifications to these configurations will be readily apparent to those skilled in the art, and generic principles defined herein may be applied to other configurations. Thus, many changes and modifications may be made to the invention, by one having ordinary skill in the art, without departing from the spirit and scope of the invention.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A reference to an element in the singular is not intended to mean "one and only one" unless specifically stated, but rather "one or more." The term "some" refers to one or more. The term "exemplary" refers to an example or illustration. All structural and functional equivalents to the elements of the various configurations described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. An optical switching and delay system for optical encryption and/or optical decryption, comprising:

a first switch bank configured to receive an optical signal in a first arrangement, the first switch bank configured to route the optical signal to a first set of optical delay lines according to a first switching arrangement key;

the first set of optical delay lines communicatively coupled to the first switch bank, the first set of optical delay lines configured to provide delays to the optical signal;

a first combiner communicatively coupled to the first set of optical delay lines, the first combiner configured to receive the optical signal with delays from the first set of optical delay lines, the first combiner configured to combine the optical signal into a second arrangement;

a first processor communicatively coupled to the first switch bank, the first processor configured to receive the first switching arrangement key, the first processor configured to control the first switch bank according to the first switching arrangement key, wherein the first switching arrangement key comprises a set of instructions for routing the optical signal; and an interferometer configured to impress radio frequency (RF) information onto optical pulse carriers and to produce the optical signal in the first arrangement, wherein the first switch bank comprises a demultiplexer and multiple switches, wherein the optical signal comprises optical pulses, and wherein the demultiplexer comprises one input and multiple outputs, the multiple outputs comprise a first output and a second output, and the demultiplexer is configured to output a first set of the optical pulses onto the first output and a second set of the optical pulses onto the second output.

2. The optical switching and delay system of claim 1, further comprising:

a second switch bank configured to receive the optical signal in the second arrangement, the second switch bank configured to route the optical signal to a second set of optical delay lines according to a second switching arrangement key;

the second set of optical delay lines communicatively coupled to the second switch bank, the second set of optical delay lines configured to provide delays to the optical signal;

a second combiner communicatively coupled to the second set of optical delay lines, the second combiner configured to combine the optical signal into the first arrangement; and a second processor communicatively coupled to the second switch bank, the second processor configured to receive the second switching arrangement key, the second processor configured to control the second switch bank according to the second switching arrangement key, wherein the second switching arrangement key comprises a set of instructions for routing the optical signal.

3. The optical switching and delay system of claim 2, wherein the second switch bank is a duplicate of the first switch bank, wherein the second processor is a duplicate of the first processor, wherein the second switching arrangement key matches the first switching arrangement key, and wherein the second set of optical delay lines is a duplicate of the first set of optical delay lines in a reverse order.

4. The optical switching and delay system of claim 1, wherein the multiple switches comprise a first switch and a second switch, the first set of optical delay lines comprises a first optical delay line and a second optical delay line, the first output is coupled to the first switch, the first switch is coupled to the first optical delay line, the second output is coupled to the second switch, the second switch is coupled to the second optical delay line.

5. The optical switching and delay system of claim 1, further comprising a wavelength division multiplexer system configured to generate optical pulse trains having multiple optical carrier signals.

6. The optical switching and delay system of claim 1, wherein the first combiner comprises one or more multiplexers.

7. The optical switching and delay system of claim 1, wherein the first switch bank comprises a single input, multiple output switch.

8. The optical switching and delay system of claim 1, wherein the optical signal in the first arrangement includes optical pulses, wherein the optical signal in the second arrangement includes optical pulses, wherein a spacing, order, or spacing and order among the optical pulses in the first arrangement are different from a spacing, order, or spacing and order among the optical pulses in the second arrangement.

9. The optical switching and delay system of claim 1, wherein the optical signal remains as an optical signal until the optical signal is in the second arrangement, wherein the first switch bank, the first set of optical delay lines, and the first combiner are configured to transform the optical signal in the first arrangement into the optical signal in the second arrangement without the optical signal being converted into a digital signal.

10. An optical switching and delay method for optical encryption and/or optical decryption, comprising the steps of:

receiving an optical signal in a first arrangement;

receiving a first switching arrangement key, the first switching arrangement key comprising a set of instructions for routing the optical signal;

routing the optical signal to a first set of optical delay lines according to the first switching arrangement key;

delaying the optical signal by a first set of delays;

receiving the optical signal with the first set of delays;

combining the optical signal into a second arrangement;

receiving the optical signal in the second arrangement;

receiving a second switching arrangement key, the second switching arrangement key comprising a set of instructions for routing the optical signal;

routing the optical signal to a second set of optical delay lines according to the second switching arrangement key;

delaying the optical signal by a second set of delays; and combining the optical signal into the first arrangement;

wherein the second switching arrangement key matches the first switching arrangement key, and wherein the second set of optical delay lines is a duplicate of the first set of optical delay lines in a reverse order.

11. The optical switching and delay method of claim 10, wherein the optical signal remains as an optical signal until the optical signal is in the second arrangement, wherein the optical signal in the first arrangement is transformed into the optical signal in the second arrangement without the optical signal being converted into a digital signal.

12. An optical switching and delay system for optical encryption and/or optical decryption, comprising:

means for receiving an optical signal in a first arrangement;

means for receiving a first switching arrangement key, the first switching arrangement key comprising a set of instructions for routing the optical signal;

means for routing the optical signal to a first set of optical delay lines according to the first switching arrangement key;

means for delaying the optical signal by a first set of delays;

means for receiving the optical signal with the first set of delays;

means for combining the optical signal into a second arrangement; means for receiving the optical signal in the second arrangement;

means for receiving a second switching arrangement key, the second switching arrangement key comprising a set of instructions for routing the optical signal;

means for routing the optical signal to a second set of optical delay lines according to the second switching arrangement key;

means for delaying the optical signal by a second set of delays; and means for combining the optical signal into the first arrangement;

wherein the second switching arrangement key matches the first switching arrangement key, and wherein the second set of optical delay lines is a duplicate of the first set of optical delay lines in a reverse order.

13. The optical switching and delay system of claim 12, wherein the optical signal remains as an optical signal until the optical signal is in the second arrangement, wherein the optical signal in the first arrangement is transformed into the optical signal in the second arrangement without the optical signal being converted into a digital signal.

* * * * *